US008876618B1

(12) United States Patent
Brown

(10) Patent No.: US 8,876,618 B1
(45) Date of Patent: Nov. 4, 2014

(54) CUE STICK FOR BILLIARDS SPORTS

(71) Applicant: Lienard Brown, Richmond, CA (US)

(72) Inventor: Lienard Brown, Richmond, CA (US)

( * ) Notice: Subject to any disclaimer, the term of this patent is extended or adjusted under 35 U.S.C. 154(b) by 0 days.

(21) Appl. No.: 14/055,570

(22) Filed: Oct. 16, 2013

(51) Int. Cl.
*A63D 15/08* (2006.01)

(52) U.S. Cl.
CPC ..... *A63D 15/08* (2013.01)
USPC ..... 473/44

(58) Field of Classification Search
CPC .... A63D 15/08; A63D 15/083; A63D 15/086
USPC ..... 473/44–51
See application file for complete search history.

(56) References Cited

U.S. PATENT DOCUMENTS

| | | | | |
|---|---|---|---|---|
| 711,906 | A * | 10/1902 | Lyon | 473/44 |
| 1,173,070 | A * | 2/1916 | Walter | 473/44 |
| 1,280,876 | A * | 10/1918 | Seenan | 473/44 |
| 1,505,609 | A * | 8/1924 | Seeman et al. | 473/44 |
| 3,334,901 | A * | 8/1967 | Steffes | 473/44 |
| 3,368,271 | A * | 2/1968 | Scheffler | 29/411 |
| 3,468,538 | A * | 9/1969 | Johnson | 473/44 |
| 5,016,877 | A | 5/1991 | Lowery | |
| 5,299,983 | A | 4/1994 | Pfost et al. | |
| 5,725,437 | A | 3/1998 | Mccarty et al. | |
| 5,749,788 | A * | 5/1998 | Bourque | 473/44 |
| 5,820,473 | A | 10/1998 | Lambros | |
| 6,110,051 | A | 8/2000 | Mccarty et al. | |
| 6,162,128 | A | 12/2000 | Mccarty et al. | |
| 6,398,660 | B1 | 6/2002 | Probst et al. | |
| 6,666,774 | B2 | 12/2003 | Mabe, Jr. et al. | |
| 7,297,068 | B2 | 11/2007 | Costain et al. | |
| 7,422,525 | B2 | 9/2008 | Chang | |
| 7,431,655 | B2 | 10/2008 | Mccarty et al. | |
| 7,431,656 | B2 | 10/2008 | Titus | |
| 7,507,164 | B2 | 3/2009 | Owen | |
| 8,047,927 | B2 | 11/2011 | Henry | |
| 8,075,414 | B2 | 12/2011 | Owen et al. | |
| 8,075,415 | B2 | 12/2011 | Owen et al. | |
| 2002/0072424 | A1* | 6/2002 | Yu | 473/44 |
| 2003/0224865 | A1* | 12/2003 | Lai | 473/44 |
| 2004/0009822 | A1 | 1/2004 | Mccarty | |
| 2006/0089203 | A1 | 4/2006 | Costain et al. | |
| 2007/0010340 | A1 | 1/2007 | Miki | |
| 2007/0275786 | A1 | 11/2007 | Henri | |
| 2007/0281794 | A1 | 12/2007 | Thurber et al. | |
| 2008/0026860 | A1 | 1/2008 | Titus et al. | |
| 2008/0026861 | A1* | 1/2008 | Costain et al. | 473/44 |
| 2008/0064515 | A1 | 3/2008 | Titus | |
| 2008/0139329 | A1 | 6/2008 | Chang | |
| 2008/0153612 | A1 | 6/2008 | Bowe | |
| 2008/0220887 | A1* | 9/2008 | Evans et al. | 473/2 |
| 2008/0318700 | A1 | 12/2008 | Chang | |
| 2009/0111595 | A1* | 4/2009 | Owen et al. | 473/44 |

(Continued)

FOREIGN PATENT DOCUMENTS

| | | | | |
|---|---|---|---|---|
| GB | 2209681 | A * | 5/1989 | A63D 15/08 |

*Primary Examiner* — Mark Graham
(74) *Attorney, Agent, or Firm* — Joshua D. Isenberg; JDI Patent

(57) ABSTRACT

A cue stick for billiards sports has a forearm with an elongated inner cavity that is filled with a filling material. The filling material may be cork, or a similar material that is resilient and/or deformable to provide improved dynamic characteristics upon striking a cue ball. The forearm may also include an improved geometric structure at its joint end which connects with the shaft, whereby an outer housing of the forearm has a solid construction at its joint end with a joint collar affixed thereto.

20 Claims, 3 Drawing Sheets

(56) References Cited

U.S. PATENT DOCUMENTS

| | | | | |
|---|---|---|---|---|
| 2009/0253525 | A1 | 10/2009 | Lickfold | |
| 2009/0270192 | A1 | 10/2009 | Titus et al. | |
| 2010/0160055 | A1 | 6/2010 | Suit | |
| 2010/0190562 | A1 | 7/2010 | Henri | |
| 2010/0196677 | A1 * | 8/2010 | Barretto | 428/195.1 |
| 2012/0190467 | A1 | 7/2012 | Liebl | |

* cited by examiner

CUE STICK FOR BILLIARDS SPORTS

FIELD

The present disclosure relates to cue sticks for billiards sports. In particular, aspects of the present disclosure relate to forearm structures of cue sticks for billiards sports.

BACKGROUND

Billiards sports, including pocket-based games such as pool and snooker, as well as related games such as carom billiards, require specialized equipment for play. This typically includes at least a cue stick, a set of balls, and a table. The balls in any billiards sport typically include one or more cue balls, which a player directly strikes with the tip of the cue stick, as well as a set of object balls, which a player typically targets with the cue ball but does not strike directly with the cue stick. The table defines a playing surface for the billiards sport and is typically lined with cloth or a similar material in order to impart desired frictional and dynamic characteristics to the balls during play. Cushioned sidewalls of the billiards table enclose the surface and define the playing area of the particular billiards sport involved. Within this basic framework, design variations on the specialized equipment are possible among the different sports, as well as further adaptations within a particular sport.

For example, a billiards table that is designed for pool defines a rectangular playing surface with cushioned sidewalls formed at its perimeter, and a set of holes (known as "pockets") at fixed points on the perimeter of the playing surface. There are six pockets in a standard pool table, four "corner pockets," one at each of the four corners of the rectangle, and two "side pockets," one at the center of each of the longer sides of the rectangle. Standard pool tables range in size from 3.5 feet by 7 feet to 4.5 feet by 9 feet. Different game types within the sport of pool may involve different numbers of object balls depending on the particular game-type involved (e.g., 8-ball, 9-ball, straight pool, etc.). Cue sticks designed for pool are elongated tapered sticks defining a straight axis along their length, and typically average 58 inches in length. High quality cue sticks for pool are often provided in a detachable two-piece configuration divided near the middle, with a butt section and a shaft section connectable at a joint, although in some instances these two main sections may be integrally formed in a single continuous piece without a detachable joint.

A billiards table designed for snooker has the same general six pocket layout as a pool table, with a rectangular playing surface having cushioned sidewalls; however, full size snooker tables are typically larger, at a standard size of 6 feet by 12 feet, than tables designed for pool, and have smaller pockets with curved lead-ins. Cue sticks designed for snooker are often slightly shorter than cue sticks designed for pool, at a typical length of approximately 55 inches, but with one or more detachable butt extensions that can extend the total length of the snooker cue stick to several inches longer than traditional pool cue sticks. As in pool, cue sticks designed for snooker are generally tapered and elongated sticks with a straight axis, and may have primarily two-piece configurations with a butt section and a shaft section (in addition to any butt extensions). However, in billiards cue sticks designed for snooker, the joint between the two primary sections is often closer to the butt end of the cue stick, at approximately three-quarters down the length of the stick. The different sections of the cue stick may have a generally cylindrical and tapered design, as with pool; however, the generally conical and tapered butt section of the cue stick often also has a flattened side adapted for certain shots unique to snooker that are not typically allowed in pool, and the flattened side may also facilitate a consistent grip on the cue stick by the player.

Like pool and snooker, the sport of carom billiards generally utilizes a rectangular table covered in cloth or similar material, with cushioned sidewalls at a perimeter of the playing surface, but the table does not have any pockets and is typically 5 feet by 10 feet in size. Cue sticks for carom billiards have the same general design as cue sticks for pool and snooker, but are typically shorter and lighter than cue sticks designed for pool, on average. While generally configured as an elongated stick with a tapered geometry, they may also have different butt and tip sizes.

Regardless of the particular billiards sport involved, cue sticks are generally elongated tapered sticks with a wider portion proximate a butt end and a narrower portion proximate a tip end, defining a straight axis along the length of the stick. Cue sticks designed for billiards may include different sections which are well defined in the cue stick art, including a tip and ferrule in a shaft section of the cue stick, as well as a forearm, handle, and butt sleeve in the butt section, with a joint connecting the butt to the shaft. In typical use, the player holds the cue stick with two hands near to opposing ends of the stick. A rearward "grip hand" is used to generate axial force on the cue stick and grips the stick on the handle of the butt section, while a frontward "bridge hand" located near the narrower tip end on the shaft guides the stick and holds the line of aim for the player. Individual cue stick designs may vary somewhat in dimensions depending on factors such as the size of the player, personal preferences, and the particular billiard sport involved, but all have a design (length, shape, physical characteristics, and the like) adapted to permit a player to strike a cue ball with the tip of the cue stick in this two-handed manner.

High level players can exert very fine control over the path of the cue ball during a shot by precisely controlling the parameters with which the cue ball is struck with the cue stick, including parameters such as the aiming line of the cue stick, axial force generated during a stroke, elevation of the butt end, and strike point on the cue ball at which the tip of the cue stick make contact (e.g., to generate spin on the cue ball, known as "english"). However, precise control is highly dependent upon the physical characteristics of the cue stick. For example, striking a cue ball away from its center (e.g., to impart english) may cause the cue ball to deflect away from the direction of the line aim, rendering it difficult for the player to precisely control the shot, and the amount and consistency of deflection may vary more or less depending on the construction of the cue stick.

It is within this context that the present disclosure arises.

SUMMARY

An implementation of the present disclosure may include a forearm for a billiards sport cue stick, the forearm comprising: an elongated outer housing having a first end, a second end opposing the first end, and an elongated inner cavity; a resilient filling material disposed in the inner cavity, wherein the outer housing is formed from a rigid material, wherein the filling material radially adjoins an inner surface of the elongated outer housing.

Another implementation may include a butt for a cue stick for a billiards sport, the butt comprising: a forearm, a handle axially adjoining the forearm, and a butt sleeve axially adjoining the handle, the forearm comprising: an elongated outer housing having a first end, a second end opposing the first end, and an elongated inner cavity; a resilient filling material disposed in the inner cavity, wherein the outer housing is formed from a rigid material, wherein the filling material radially adjoins an inner surface of the elongated outer housing.

Yet another implementation of the present disclosure may include a cue stick for a billiards sport comprising: a shaft; and a butt, the butt comprising: a forearm, a handle axially adjoining the forearm, and a butt sleeve axially adjoining the handle, the forearm comprising: an elongated outer housing having a first end, a second end opposing the first end, and an elongated inner cavity; a resilient filling material disposed in the inner cavity, wherein the outer housing is formed from a rigid material, wherein the filling material radially adjoins an inner surface of the elongated outer housing.

BRIEF DESCRIPTION OF THE DRAWINGS

The teachings of the present disclosure can be readily understood by considering the following detailed description in conjunction with the accompanying drawings, in which.

DETAILED DESCRIPTION

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

As used herein, "adjoin" means that the adjoining elements share a common border where they adjoin.

As used herein, directional terminology is defined with reference to a cue stick axis. Thus, an "axial direction" refers to a direction in which the cue stick axis is oriented; a "radial direction" refers to a direction extending radially from the cue stick axis; and a "circumferential direction" refers to a direction extending circumferentially around a cue stick axis.

Aspects of the present disclosure relative to improved forearm structures for cue sticks designed for billiards sports, such as pool, snooker, and carom billiards. A forearm in accordance with the present disclosure may include an elongated outer housing defining an elongated inner cavity. A filling material such as cork may be disposed in the inner cavity to impart improved dynamic characteristics, which may include increased cue ball velocity and decreased deflection, as well as improved weight balance.

The outer housing may also include a solid region axially adjoining the inner cavity and filling material, near a cue stick joint of a detachable cue stick, in order to impart a solid feel to the cue stick while maintaining the improved dynamic characteristics provided by the filling material.

These and further aspects of the present disclosure will be apparent upon consideration of the following detailed description of various implementation details and their accompanying drawings.

Figure 1A:
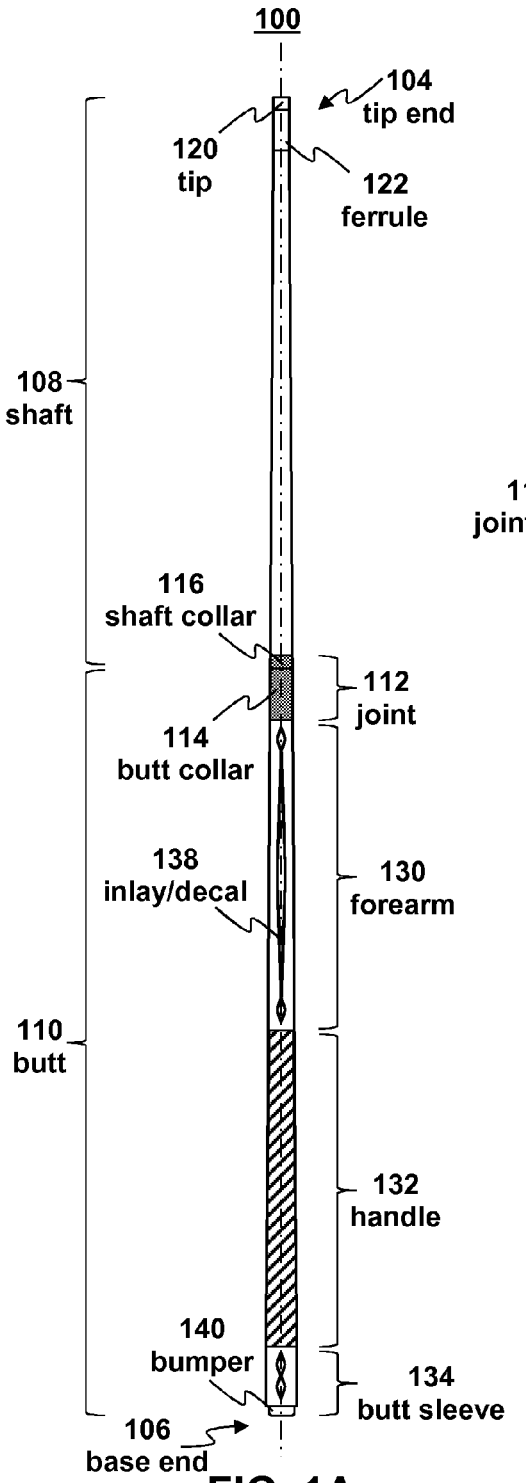
FIG. 1A is a schematic diagram of an example cue stick for a billiards sport.
Figure 1B:
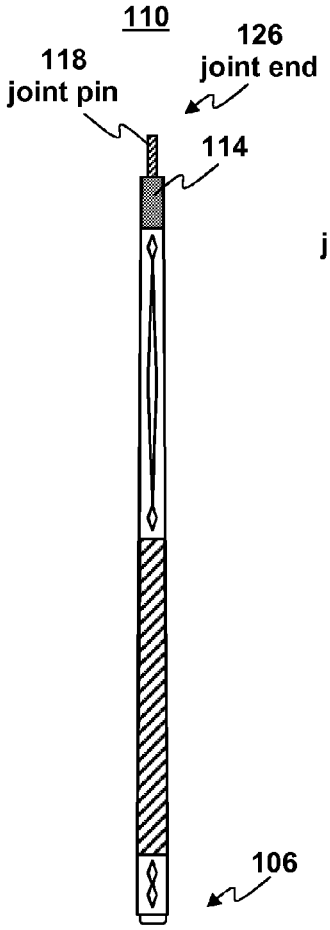
FIG. 1B is a schematic diagram of a detached butt of the cue stick of FIG. 1A.
Figure 1C:
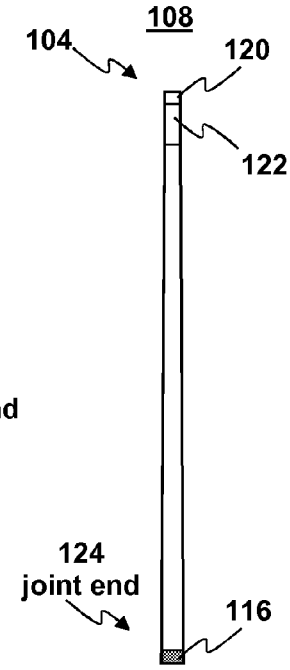
FIG. 1C is a schematic diagram of a detached shaft of the cue stick of FIG. 1A.

A cue stick for billiards sports 100 is depicted in FIGS. 1A-1C in order to illustrate various components of a cue stick as well as to serve as a legend for the terminology used throughout the present disclosure.

As illustrated in FIG. 1A, the example cue stick 100 is an elongated stick generally shaped as a tapered cylinder and defining a straight axis 102 throughout its length, and the taper of the cue stick 100 is such that a tip end 104 of the stick is narrower than a base end 106 of the stick. The cue stick 100 includes two main sections, a shaft section 108 and a butt section 110, which are detachable and connectable by a joint 112 in the example depicted in FIGS. 1A-1C.

The example joint 112 may be made up of joint collars which include a butt collar 114 affixed to the stick as part of the butt section 110 and a shaft collar 116 affixed to the stick as part of the shaft section 108, and the joint 112 may function as a fastener between the butt 110 and the shaft 108. As shown in FIG. 1B, the joint 112 may include a joint pin 118 protruding from one of the joint collars, and the joint pin 118 may mate with a hole extending through a center of the other joint collar portion in order to preserve the alignment of the butt 110 and shaft 108 along the cue stick axis 102 when the two main portions are attached. The joint 112 may provide a threaded connection between the butt and the shaft, and the joint pin 118 may be in the form of a joint screw providing a male threaded portion configured to mate with a corresponding female threaded portion of the shaft collar 116.

In the example depicted in FIGS. 1B-1C, the joint pin 118 is depicted as part of the butt 110 of the cue stick, but it is noted that the joint pin 118 may alternatively be affixed to the shaft section 108, in which case the shaft collar 116 may contain a male threaded connection with the female threaded connection of the butt collar 114. It is also noted that the cue stick 100 may alternatively be formed with integral butt 110 and shaft 108 sections formed from a continuous elongated piece, in which case the joint 112 may be omitted entirely because the two main sections 108, 110 would not be detachable in such a configuration.

The tip end 104 of the cue stick 100 may include a tip 120 with which a player may strike the cue ball, as well as a ferrule 122 axially adjoining the tip 120 in order to reinforce the tip for ball striking. The shaft 108 may include a variety of different taper geometries. By way of example, as shown in FIG. 1C, the shaft 108 may have a "European taper" in which the radius of the shaft gradually decreases in a continuous manner from the joint end 124 of the shaft to the ferrule 122 at the tip end 104. Alternatively, the shaft 108 may have a "pro taper" in which the shaft includes a substantial portion of constant radius that extends axially from the tip 120 to a portion near the joint end 124, at which point the radius of the shaft 108 may gradually increase in an axial direction towards the joint end 124. A typical pro taper has a constant diameter until a portion about 12-14 inches away from the joint, at which point the diameter gradually increases in the axial direction towards the joint. The shaft 108 may yet further have some alternative, less common, taper geometry that results in the joint end 124 of the shaft being wider than the tip end 104.

As shown in FIGS. 1A-1C, the butt section 110 of the example cue stick 100 has a plurality of different sections, including a forearm 130, a handle 132, and a butt sleeve section 134. The handle 132 is located between the forearm 130 and the butt sleeve 134, and provides a surface for the player to grip with the player's grip hand to generate axial force on the cue stick during a shot. The handle 132 may include a wrap on its outer surface to enhance the grip of the cue stick for the player, and the wrap may be made of a variety of different flexible materials, such as leather, linen, rubber, and the like. Alternatively, the wrap may be omitted from the handle in order to provide a more natural feel for the handle of the cue stick in accordance with the player's preference. The forearm 130 and butt sleeve 134 are located at opposing ends of the handle 132, with the forearm 130 axially adjoining the handle 132 towards the joint end 126 of the handle, and the butt sleeve 134 axially adjoining the handle 132 towards the base end 106 of the handle.

The forearm 130 may be made of a rigid material and be configured to mate with the butt collar 114. The rigid material of the forearm may be a hard wood, such as East Indian Rosewood, Bird's Eye maple, Zebra wood, Blood wood, Cocobolo, Black Ebony, Red Heart, Becote, and others. The forearm 130 may alternatively be made of a rigid material other than wood, such as fiberglass, graphite, or another material. A variety of other exotic woods are possible for constructing the rigid forearm portion and are well known to those familiar with the manufacture of billiards cue sticks, any of which may be used as a rigid forearm material in accordance with aspects of the present disclosure. It is noted that the handle and butt sleeve of the butt, as well as the elongated portion of the shaft 108 extending between the ferrule 122 and the joint 112 may also be made of a similar rigid material as the forearm.

The forearm 130 of the illustrated cue stick 100 includes a decorative inlay (embedded into the forearm material) or decal (disposed on the outer surface of the forearm) 138, and the inlay/decal 138 may be provided solely for aesthetic purposes. It is noted that the butt sleeve 134, and potentially any other section of the cue stick having a visible exterior surface, may also include an inlay/decal, and such additional decorative elements may be of a similar theme to the forearm inlay/decal 138. The butt section 110 may terminate with a bumper 140 at its base end 106, which may be made of a resilient material to protect the end of the cue stick from impacts, e.g. nicks and chips when resting on the ground, and may also affect vibrational characteristics of the cue stick upon ball strikes. It is note that in some implementations of the example cue stick 100, the butt may instead be extended with one or more additional butt extensions instead of the bumper 140 in order to extend the length of the billiards cue stick 100, such as for an implementation designed for snooker.

In the example cue stick butt 110, different sections such as the forearm 130, handle 132, and butt sleeve 134 may initially be separate pieces that are fixedly attached to form the butt section, e.g. using joint screw connections therebetween. However, unlike the joint 112 between the butt 110 and the shaft 108, which is designed to be assembled and disassembled easily by the player between uses for easy transport, the fasteners between the different sections 130,132,134 within the butt may be designed to remain permanently fixed. It is also noted that one or more of these sections may instead be integrally formed from a continuous piece that extends along the length in the axial direction. It is also noted that the butt may also have a tapered geometry, with a smaller diameter at its joint end 126 than its base end 106.

It is noted that the example billiards cue stick 100 may have a variety of modifications and variations to its geometry and physical characteristics in order to adapt it to any particular billiards sport, such as pool, snooker, or carom billiards mentioned above, in a manner that is well known in the art.

Figure 2A:
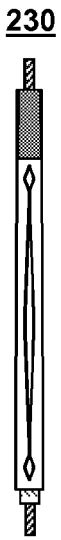
FIG. 2A is a schematic diagram of an example forearm for the butt of the cue stick of FIGS. 1A-1B.
Figure 2B:
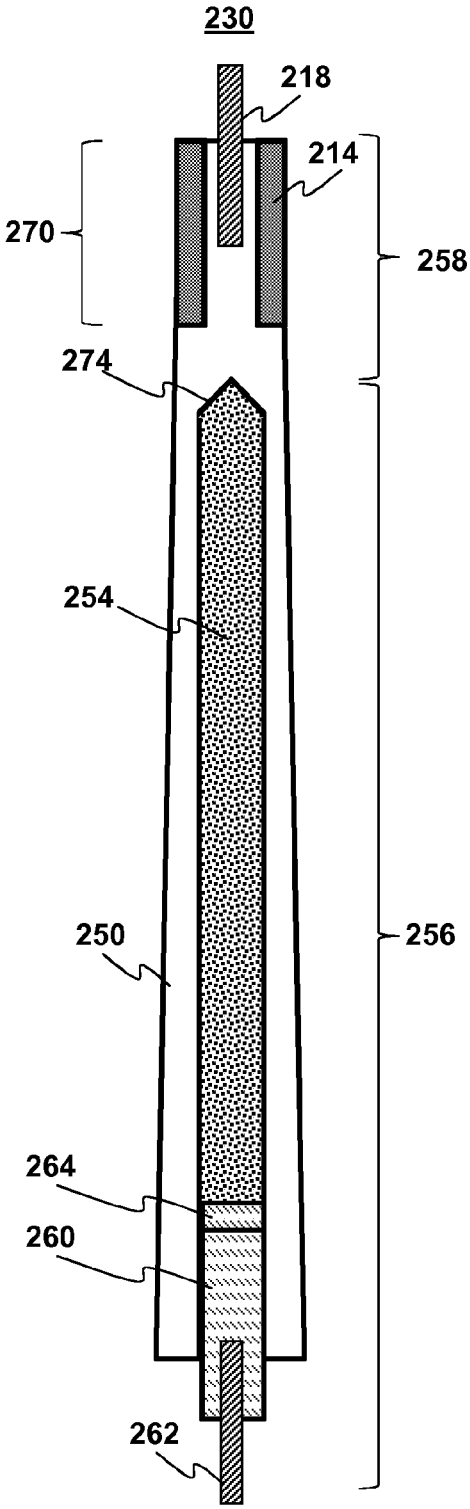
FIG. 2B is a cross sectional diagram of the forearm depicted in FIG. 2A.
Figure 2C:
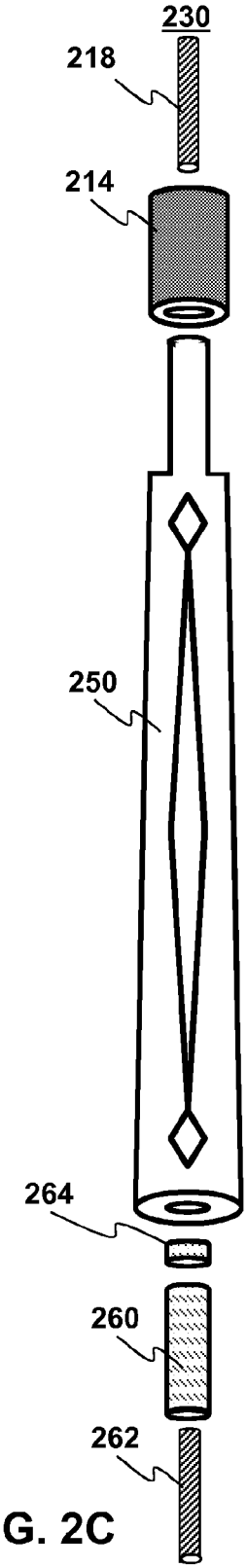
FIG. 2C is an exploded view diagram of the fore arm depicted in FIG. 2A.
Figure 2D:
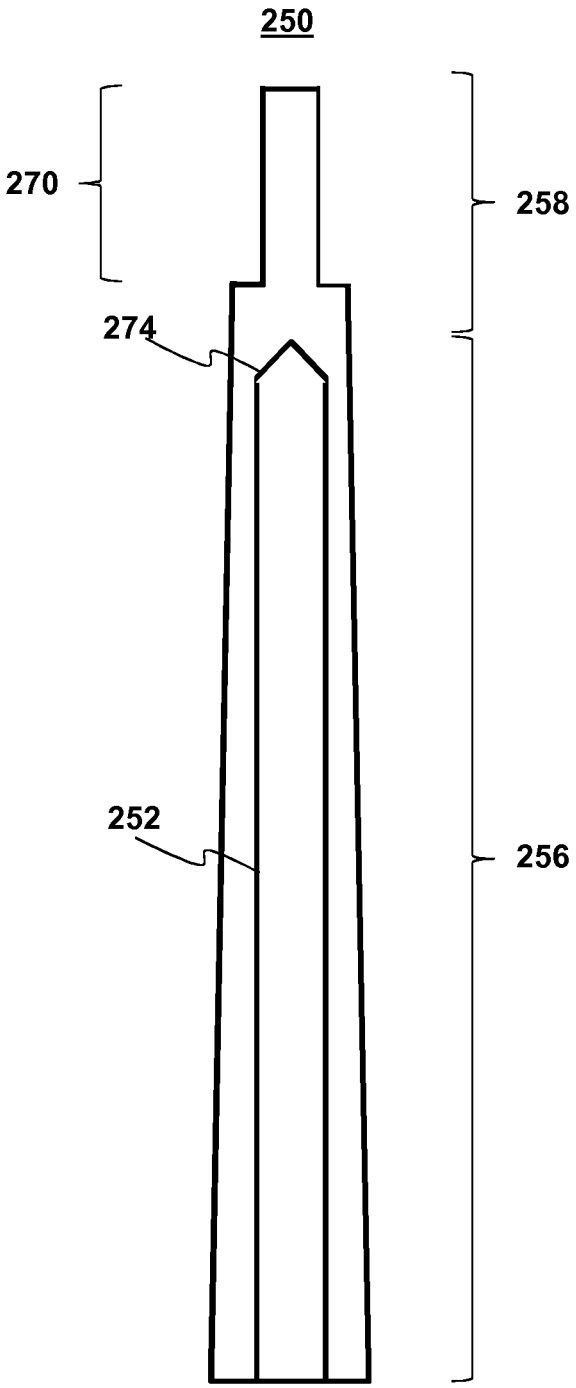
FIG. 2D is a cross section of an example outer housing of the forearm depicted in FIG. 2A.

A detailed illustration of an example forearm 230 for a cue stick designed for billiards is depicted in FIGS. 2A-2D in order to illustrate various aspects of the present disclosure. FIG. 2A is a schematic illustration of an example forearm 230. FIG. 2B is a schematic illustration of a cross section of the forearm 230 depicted in FIG. 2A. FIG. 2C is an exploded view of the fore arm 230 depicted in FIGS. 2A-2B. FIG. 2D is a cross section of an example outer housing 250 of the example forearm 230 depicted in FIGS. 2A-2C. The example forearm 230 of FIGS. 2A-2D may be implemented in a billiards cue stick having any or all of the characteristics of the example cue stick 100 shown and described with reference to FIGS. 1A-1C.

As shown in FIGS. 2A-2D, the example forearm 230 may include an elongated outer housing 250 which defines an elongated inner cavity 252. A filling material 254 may be disposed within the inner cavity 252, and may be radially adjoining an inner surface of the elongated outer housing 250 (e.g. the sidewalls of the filling material and the inner surface of the housing adjoin). The outer housing 250 may be made of a rigid material which maintains the structural integrity of the forearm 230. By way of example, and not by way of limitation, the rigid material of the outer housing 250 may be any conventional cue stick material, such as maple, any of a variety of other hard woods, or a non-wood material such as graphite or plastic. The filling material 254 may be a resilient material that provides altered dynamic characteristics to the cue stick when axial impacts from the tip of the shaft are transmitted through the shaft to the forearm 230 upon striking a cue ball. The filling material 254 may also be lighter than the rigid housing material to lighten the overall weight of the butt, alter how the weight is axially distributed throughout the cue butt, and tailor the feel of the cue stick.

In a preferred implementation, the filling material 254 is cork, and may be of slightly larger size than the diameter of the inner cavity 252 in order to pack it tightly into the inner cavity. The cork may also be slightly compressed when disposed in the inner cavity and may be fixed in the cavity 252 without a need for chemicals such as glue or epoxy to hold the material in place due to a tight fit of the cork and resulting friction between the cork and the radially adjoined inner sidewalls of the cavity 252. In some implementations, the cork used may be cork designed for or derived from actual wine bottles, repurposed for use as the filling material 254 in the inner cavity 252 of the forearm 230. It is noted that using recycled or repurposed wine bottle corks may provide several benefits over other filling materials, including a sustainable design. Furthermore, it has been discovered that wine bottle corks have ideal physical characteristics for use in the forearm, including an ideal diameter for the inner cavity, as well as ease in manufacturability for high quality, hand-made pool cues in which the individual, discrete corks may be packed into the inner cavity from one end. Use of discrete pieces of filling material such as a plurality of discrete wine bottle corks may also further alter the dynamic characteristics provided by the cue stick forearm, due to the interface(s) between the axially adjoining discrete pieces of filling material. It is further noted that cork material similar or identical to that commonly used in wine bottles provides ideal weight and resiliency for the feel of the cue butt and the dynamics of the cue stick when striking the cue ball.

While cork, or a cork-like material may be preferred as the filling material 254 in various implementations of the present disclosure, it is important to note that a variety of other resilient materials may be used instead of, or in conjunction with, cork as the filling material 254. By way of example, the filling material include rubber, plastic compounds such as are used to manufacture synthetic wine bottle corks, or another similar resilient material.

Using the example forearm 230 with an inner cavity 252 packed with a filling material 254, may provide several benefits. For example, the filling material 254 may increase velocity imparted to the cue ball when axially striking the ball with the cue stick tip, e.g., due to the resilient characteristics of the filling material contained in the inner cavity. Furthermore, the cue ball deflection may be reduce by reducing a characteristic length through which impacts are transmitted through the length of the cue stick from the shaft, e.g. by about 50% or by an amount corresponding to the relative location near the joint at which the inner cavity begins. Furthermore, as noted above, the filling material may be made lighter than the rigid material of the forearm housing and the rigid materials traditionally used in forearms, thereby providing a more desirable weight and weight distribution for the cue stick.

Without being tied to a particular theory of operation, it is believed that the construction of the present cue stick in which the filling material 254 radially adjoins the inner surface of the elongated outer housing 250 is advantageous compared to cue sticks in which filling material is disposed in a stiff tube with the tube wall disposed between the filling material and the inner surface, such as in U.S. Pat. Nos. 8,075,414 and 8,075,415. Specifically, it is believed that stiff tube material would undesirably transmit the impact of the cue striking a ball axially along the forearm and that this would reduce velocity imparted to the cue ball and increase cue ball deflection. Radially adjoining the filling material 254 to the inner surface of the outer housing 250 is believed to allow the filling material to absorb the impact and provide improved dynamic characteristics upon striking a cue ball.

At the end of the forearm 230 closer to the base end of the butt section, the inner cavity 252 and the filling material 254 may be terminated by a joint with a handle (such as handle 132 of FIGS. 1A-1C, handle not pictured in FIGS. 2A-2D), so that this handle joint may axially adjoin the forearm 230 to the handle. By way of example, and not by way of limitation, as shown in FIGS. 2B and 2D, the handle joint may include a plug 260 insertable into the inner cavity 252, after the filling material 254, with a male joint screw 262 concentrically fixed to the plug 260 and protruding therefrom, which is configured to mate with a corresponding female threaded hole in the handle (Of course, the male and female threaded connectors between the handle and forearm may be inverted so that the plug 260 has a female threaded hole and the handle has the joint screw 262 protruding therefrom). The plug 260 may also include a plug cap 264 to provide an interface between the plug 260 and the filling material 254, with the plug cap 264 axially adjoining the filling material 254, and the plug 260 axially adjoining the plug cap 264. The plug cap 264 may provide a faceted interface against the filling material, further compressing it and holding it in place, as well as enhancing the structural integrity of the handle joint than might otherwise be introduced by the filling material 254 without the plug cap 264. The plug 260 and the plug cap 264 may be made of a rigid material, such as wood, and the plug 260 may be held in place in the inner cavity by a suitable fastener, such as glue or epoxy.

In contrast to the joint between the butt and the shaft at the opposite end of the forearm 230, which may be configured to be easily detachable by the player between uses, the handle joint may be a permanent joint that is not disassemble between uses without damaging the pool cue.

It is noted that, in the example depicted in FIGS. 2A-2D, the forearm is depicted as a separate piece from the handle, but other implementations are possible. For example, the forearm may form a continuous piece with the handle, as well as other section of the butt, such as a butt sleeve portion 134 as depicted in FIGS. 1A-1C. In such an implementation, the outer housing 250 may extend beyond the forearm, and may form a housing for the handle, or even the butt sleeve, in which case it may extend the entire length of the butt section of the cue stick. In such a case, the handle joint may be omitted, and the filling material 254 may extend down into the length of the handle, or even the butt sleeve section. Likewise, another material may be disposed inside of the inner cavity after the filling material, such as a wood core or another material structurally dissimilar to the resilient filling material, depending on the desired structural and weight characteristics of the butt.

As shown in FIGS. 2B and 2D, the elongated inner cavity 252 may extend only partially along the axial length of the elongated outer housing 250, such that the axial length of the housing 250 includes both an axially extending cavity region 256 and an axially extending solid region 258, with the solid region 258 being made of the rigid material of the outer housing 250 all the way through to is axial center. By way of example, and not by way of limitation, the inner cavity 252 may be created by boring out a center of the rigid material used to form the housing 250, with the bore extending only partially through the material to create the inner cavity 256 while leaving behind the solid portion 258.

The solid portion 258 may be located proximate the joint end of the forearm 230 where the butt is connectable to the cue stick shaft by the joint. A joint collar 214, i.e. a butt collar, may be fixed to the end of the outer housing 250 to form a portion of the joint between the butt and the shaft of the cue stick for a detachable two-piece implementation. By way of example, and not by way of limitation, the butt collar 214 may be made of stainless steel, fiberglass, or any conventional joint collar material. A joint pin 218 may protrude from the joint end of the forearm and may be coaxial with the joint collar 214. Alternatively, a female joint hole may be included in the joint end of the forearm.

In various implementations, it may be desirable for the outer housing 250 to be integrally formed from a single piece of material, in order to enhance the structural integrity of the forearm, as well as enhance the structural integrity of the solid portion 258 near the joint end. Furthermore, in contrast to conventional plug based designs for cue stick joints, wherein the joint pin is fixed to a plug that is inserted into the joint collar, the joint collar 214 of the example forearm 230 may be configured to surround a portion of the integral outer housing 250 at or near the solid region 258. By way of example, the outer housing 250 may be formed from a single integral piece of rigid material, e.g. a hard wood such as maple.

As shown in FIGS. 2B-2C, the outer housing 250 may not only include a gradual taper resulting in a gradually decreasing diameter in the axial direction towards the joint end, but may also include stepped region of reduced diameter 270 at its joint end, resulting in a tenon of the housing 250 which protrudes at the joint end. In the example depicted in FIGS. 2B-2C, the joint collar 214 is fixed around the tenon at the stepped region 270, and may be held in place using a fastener such as glue or epoxy. Likewise, in the illustrated example, a joint pin 218 is coaxially inserted into the tenon, with these components collectively defining a portion of the joint to connect to a corresponding joint portion in a shaft of a cue stick.

As a result of the housing geometry depicted in FIGS. 2A-2D, including the solid region at the joint end, the cue stick may have a more structurally sound joint between its shaft and butt portions. For example, it has presently been discovered that utilizing a conventional plug based joint geometry in connection with a corked inner cavity, e.g., with an inner cavity which extends all the way through to the joint plug, may result in some drawbacks, such as an undesirable noise produced upon ball strikes due to resonance of the cue stick upon impact.

To overcome such drawbacks, as well as provide a more structurally sound joint construction, in some implementations the example outer housing 230 may include a solid region 258 near the joint, as shown in FIGS. 2B and 2D, with the inner cavity extending only partially along the axial length of the housing. By way of example, in the implementation of FIGS. 2A-2D, the filling material may be packed into the inner cavity 252 so that it also axially adjoins an inner surface of the housing 250 where the solid portion 258 begins, and this may be accomplished by packing the filling material into the inner cavity until it presses against the end of the cavity. Because the filling material may be axially adjoining the inner surface of the rigid housing, after ball strikes in which the impact is transmitted through the shaft to the butt, the ball impact may then be transmitted directly from the rigid outer housing to the filling material at the interface where they axially adjoin, rather than being transmitted from a plug to the filling material if the inner cavity were to extend. This may provide a significantly improved sound and feel of the cue stick upon impact, while also provide the dynamic benefits of the filling material 254.

It is noted that the inner cavity may include an axially extending portion that is cylindrical or substantially cylindrical in shape. In the example outer housing 250 depicted in FIGS. 2B and 2D, the housing also includes an inner bevel 274 where the inner cavity terminates and where the filling material axially adjoins the inner surface of the housing 250. This may facilitate packing of the filling material 254 into the inner cavity 252 and improve the interface between the filling material and interior surface of the housing 250 by minimizing a presence of air therebetween. By way of example, and not by way of limitation, a filling material such as a cylindrical cork may also include an opposing bevel configured to mate with the inner bevel 274 of the housing 250.

Since the outer housing 250 of the forearm 230 may be an outermost section of the forearm 230, it may also include an ornamental inlay or decal 238, which may be embedded into the outer casing 230 (inlay), or disposed on an exterior surface of the outer housing 230 (decal), in such a manner that it is visible from an exterior of the outer casing. Likewise, since the outer housing 250 may be the outermost section of the forearm 230, the outer surface of the housing 250 may also be finished with a finishing coating.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "a", or "an" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A forearm for a billiards sport cue stick, the forearm comprising:

an elongated outer housing having a first end, a second end opposing the first end, and an elongated inner cavity; and a resilient filling material disposed in the inner cavity, wherein the outer housing is an integrally formed section that is formed from a rigid material, wherein the outer housing is an outermost section of the forearm, wherein the filling material radially adjoins an inner surface of the elongated outer housing, wherein the inner cavity extends only partially through an axial length of the outer housing, and wherein the filling material is compressed into the inner cavity until it presses against an end of the inner cavity, whereby the filling material axially adjoins the inner surface of the elongated outer housing.

2. The forearm of claim 1, wherein the elongated inner cavity is a bore that extends only partially through an axial length of the outer housing, wherein the first end of the outer housing is configured to attach to a detachable shaft of a cue stick for a billiards sport, wherein the bore does not extend through the first end of the outer housing, such that the outer housing has an integral solid region made of the rigid material all the way to its axial center at the first end, and wherein the filling material is compressed into the bore until it presses against an end of the bore, whereby the filling material axially adjoins the inner surface of the elongated outer housing where the solid region begins.

3. The forearm of claim 1, wherein the first end of the outer housing is configured to attach to a shaft of a cue stick for a billiards sport, wherein the elongated inner cavity does not extend through the first end of the outer housing, wherein the first end of the elongated outer housing has a stepped portion of reduced diameter which forms a protruding tenon integral with the outer housing.

4. The forearm of claim 1, further comprising a joint collar, wherein the first end of the outer housing is configured to attach to a shaft of a cue stick for a billiards sport, wherein the elongated inner cavity does not extend through the first end of the outer housing, wherein the first end of the elongated outer housing has a stepped portion of reduced diameter which forms a protruding tenon integral with the outer housing, wherein the joint collar is affixed to the first end of the outer housing surrounding the tenon.

5. The forearm of claim 1, wherein the elongated outer housing includes an axially extending region shaped as a tapered cylinder.

6. The forearm of claim 1, wherein the elongated inner cavity includes an axially extending region shaped as a cylinder.

7. The forearm of claim 1, wherein the outer housing includes an ornamental inlay embedded therein that is visible from an outer surface of the outer housing, or wherein the outer housing includes an ornamental decal disposed on an outer surface of the outer housing that is visible from the outer surface of the outer housing.

8. The forearm of claim 1,
wherein an outer surface of the outer housing is finished with a finishing coating.

9. The forearm of claim 1,
wherein the filling material is made of cork.

10. The forearm of claim 1,
wherein the rigid material is a hard wood.

11. The forearm of claim 1,
further comprising a joint collar affixed to the first end of the outer housing,
wherein the first end of the outer housing is configured to attach to a shaft of a cue stick for a billiards sport.

12. The forearm of claim 1,
further comprising:
a joint collar affixed to the first end of the outer housing; and
a handle joint affixed to the second end of the outer housing,
wherein the first end of the outer housing is configured to attach to a shaft of a cue stick for a billiards sport,
wherein the second end of the outer housing is configured to attach to a handle of a cue stick for a billiards sport.

13. A butt for a cue stick for a billiards sport, the butt comprising:
the forearm of claim 1,
a handle axially adjoining the forearm, and
a butt sleeve axially adjoining the handle.

14. A cue stick for a billiards sport comprising:
a shaft; and
a butt, the butt comprising:
the forearm of claim 1,
a handle axially adjoining the forearm, and
a butt sleeve axially adjoining the handle.

15. The forearm of claim 1,
wherein the filling material is compressed into the inner cavity without glue or epoxy.

16. The forearm of claim 1,
wherein the filling material is cork compressed into the inner cavity without glue or epoxy.

17. A forearm for a billiards sport cue stick, the forearm comprising:
an elongated outer housing having a first end, a second end opposing the first end, and an elongated inner cavity;
a resilient filling material disposed in the inner cavity,
wherein the outer housing is formed from a rigid material,
wherein the filling material radially adjoins an inner surface of the elongated outer housing,
wherein the inner cavity extends only partially through an axial length of the outer housing,
wherein the filling material is compressed into the inner cavity until it presses against an end of the inner cavity, whereby the filling material axially adjoins the inner surface of the elongated outer housing, and
wherein the inner surface of the elongated inner cavity is beveled at a portion at which it is axially adjoined by the filling material.

18. A forearm for a billiards sport cue stick, the forearm comprising:
an elongated outer housing having a first end, a second end opposing the first end, and an elongated inner cavity; and
a resilient filling material disposed in the inner cavity,
wherein the outer housing is an integrally formed section that is formed from a rigid material,
wherein the outer housing is an outermost section of the forearm,
wherein the filling material radially adjoins an inner surface of the elongated outer housing,
wherein the filling material is a plurality of discrete repurposed wine bottle corks compressed into the inner cavity without glue or epoxy.

19. A forearm for a billiards sport cue stick, the forearm comprising:
an elongated outermost section made of a single integral piece of rigid hard wood having a first end, a second end opposing the first end, and an elongated bore extending only partially through the integral piece of hard wood and leaving behind an integral solid region of the hard wood at the first end; and
cork compressed into the bore without glue or epoxy until it presses against an end of the bore, whereby the cork axially adjoins an inner surface of the hard wood at the solid region and whereby by the cork radially adjoins the inner surface of the hard wood,
wherein the first end of the hard wood having the solid region is configured to attach to a shaft of a cue stick for a billiards sport.

20. A cue stick for a billiards sport having the forearm of claim 19, the cue stick comprising:
the shaft having a tip end and an opposing joint end; and
a butt, wherein the tip end of the shaft is configured to strike a cue ball, wherein the joint end is configured to attach to the butt, wherein the butt comprises:
the forearm, wherein the first end having the solid region is configured to attach to the joint end of the shaft,
a handle axially adjoining the forearm, and
a butt sleeve axially adjoining the handle.

* * * * *